United States Patent [19]

MacPherson et al.

[11] 4,198,767

[45] Apr. 22, 1980

[54] RECORDING SYSTEM FOR LASER WEAPON SIMULATOR

[75] Inventors: Ronald W. MacPherson, Ste. Foy; J. Clement Ethier, Quebec; J. A. Maurice Gravel, Ste. Foy, all of Canada

[73] Assignee: The United States of America as represented by the Secretary of the Army, Washington, D.C.

[21] Appl. No.: 921,374

[22] Filed: Jul. 3, 1978

[51] Int. Cl.[2] ..... F41J 1/16

[52] U.S. Cl. ..... 35/25

[58] Field of Search ..... 35/12 R, 12 N, 25, 8 R; 273/101.1, DIG. 28

[56] References Cited

U.S. PATENT DOCUMENTS

| | | | |
|---|---|---|---|
| 2,826,677 | 3/1958 | Jobanek | 35/25 X |
| 2,843,028 | 7/1958 | Ward et al. | 35/25 |
| 3,057,258 | 10/1962 | Milinowski et al. | 35/25 |
| 3,507,055 | 4/1970 | Claunch et al. | 35/25 |
| 3,549,147 | 12/1970 | Katter | 273/101.1 |
| 3,838,856 | 10/1974 | Takeya et al. | 273/101.1 |
| 3,964,178 | 6/1976 | Marshall et al. | 273/101.1 |

OTHER PUBLICATIONS

*Laser Focus*; Nov. 1975; p. 26.

*Primary Examiner*—Vance Y. Hum

*Attorney, Agent, or Firm*—Nathan Edelberg; Jeremiah G. Murray; Daniel D. Sharp

[57] ABSTRACT

A recording system for use with a laser weapon simulator in which a laser beam is transmitted through a window, bearing a target visible to the marksman, and onto a film record. A filter in the window blocks passage of the ambient light but passes the light from the laser beam and the back face of the window is provided with an illuminated, generally superimposed replica of the target. The replica of the target is photographed at the instant of firing by means of a camera, the shutter of which is electronically coupled to the weapon simulator, thereby permanently recording the position of the laser hit.

5 Claims, 4 Drawing Figures

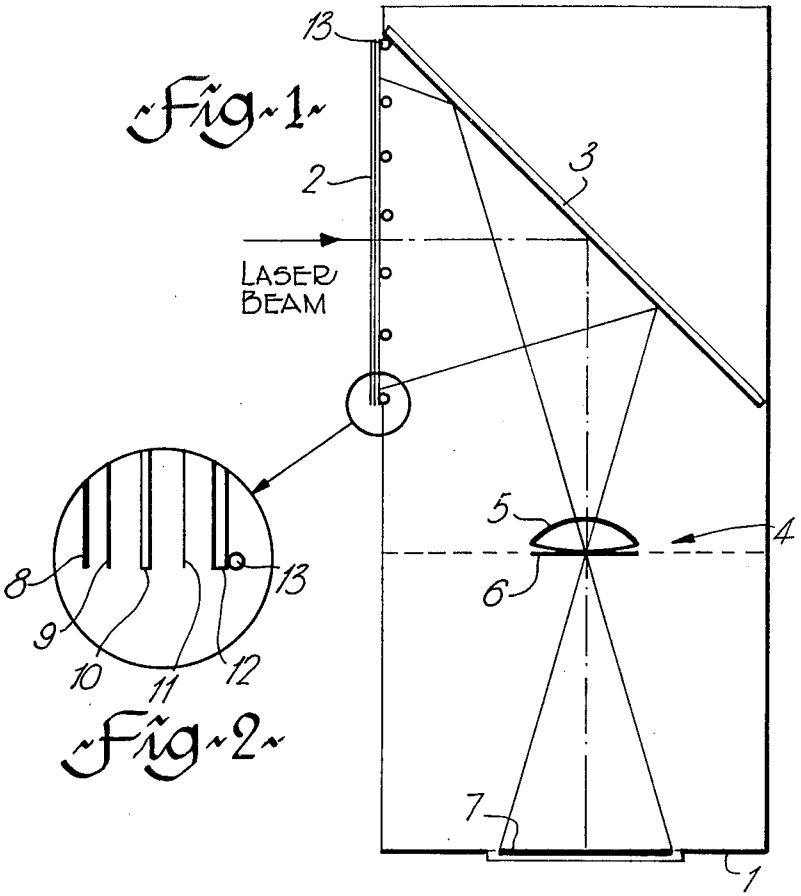
Fig. 1
Fig. 2
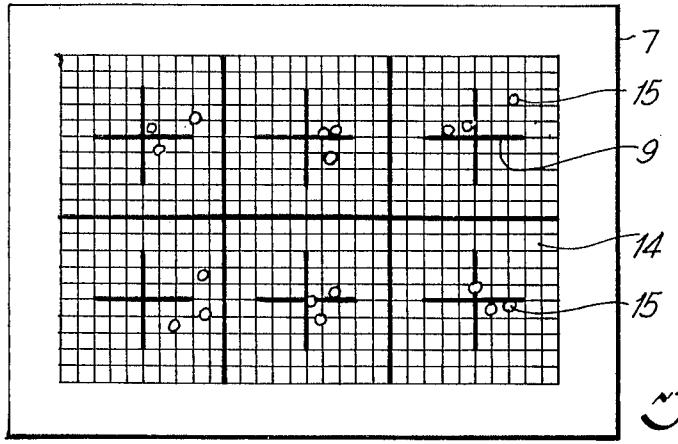
Fig. 4
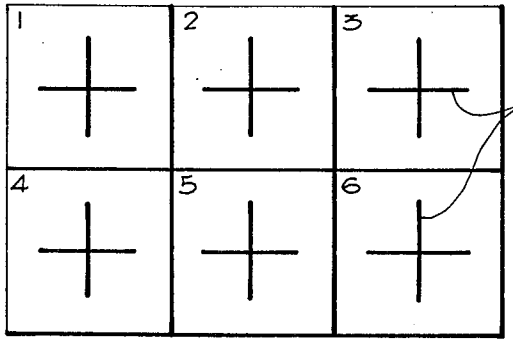
Fig. 3

RECORDING SYSTEM FOR LASER WEAPON SIMULATOR

BACKGROUND OF THE INVENTION

This invention relates to a recording system for use with a light beam weapon simulator. Combat arms schools, rifle clubs and the like have, in recent years, adopted laser beam weapon-simulators for training and target practice purposes. Such simulators are useful because they substantially eliminate the noise associated with the firing of live ammunition, avoid the danger associated with using live ammunition during practice and because laser beam weapon simulation is relatively inexpensive compared to the cost of live ammunition. The laser beams used in such simulators are low power lasers (class II lasers) and are eye safe, and consequently are insufficiently powerful to leave a permanent mark on the target. Certain training activities, such as grouping tests, consistency of lay and zeroing tests require a permanent marking of the target and consequently the laser weapon simulator is not practical. The use of at least small arms ammunition is still required for such tests, in view of the marking problem.

STATEMENT OF PRIOR ART

Attempts to overcome the aforesaid marking problem have been made but are not entirely satisfactory. For example there exist expensive electro-optical systems which record the beam position on a television image tube and display it on a monitor, as indicated in "Laser Focus" November 1975, p. 26. Simple systems such as the "electric eye shooting gallery" found, for example, in amusement parks is not adequate as such systems only indicate hits on point or nearly point targets and there are no means for measuring and recording miss distances, zeroing errors or the distribution of hits. An ordinary camera synchronized with a laser weapons simulator is capable, in principle, of making the required measurements and recordings. However, such a camera does not have any independent means of adjusting the relative intensities of the laser light and the target illumination for proper exposure. A simple camera system is also sensitive to ambient lighting conditions and would require time consuming positioning, focusing and exposure adjustments every time it is used in different surroundings or under different lighting conditions. Television monitors suffer from the same limitations and, in addition, are considerably more expensive. While the problem of ambient light sensitivity could probably be overcome by the use of relatively high power lasers which are capable of marking the target directly, such high power lasers are inherently less safe and may constitute a safety hazard as well as being relatively costly and unreliable.

SUMMARY OF THE INVENTION

The present invention is adapted to overcome the disadvantages of the prior art and provide a relatively low cost, low power, laser weapon simulator and target system which can be operated under ambient light conditions without extensive adjustments.

Thus by one aspect of this invention there is provided a recording system for use with a laser beam weapon simulator, comprising:

(a) a housing;

(b) window means in said housing for receiving a target;

(c) film means in said housing recording laser hits on said target;

(d) light path means between said weapon simulator and said film means and through said window means and said target; and (e) filter means in said light path between said window means and said film means for blocking ambient light from said film means and passing light from said laser beam weapon simulator.

BRIEF DESCRIPTION OF THE DRAWINGS

The invention will be described in more detail hereinafter with reference to the drawings in which:

FIG. 1 is a schematic cross sectional view of one embodiment of the mark-recorder of the present invention;

FIG. 2 is an enlarged cross sectional view of the window or screen used in the mark-recorder of FIG. 1;

FIG. 3 is a sketch of a typical target pattern as seen by the gunner; and

FIG. 4 is a sketch of a typical permanent film record using the target as shown in FIG. 3.

DESCRIPTION OF THE INVENTION EMBODIMENT

As shown in FIG. 1 the mark-recorder assembly is contained in a light tight box 1 which is provided with a window 2, described in more detail hereinafter, on one face thereof, a front surface reversing mirror 3 and a camera mechanism 4, which is provided with a focusing lens and iris diaphragm assembly 5, an electronic shutter 6 and a film, such as the readily available and relatively inexpensive Polaroid ® film, 7 preferably carried in an easily removable film holder (not shown).

A target 9 is visible from the front of the window 2 through a protective non-reflecting glass cover 8. Light from a laser weapon simulator or other suitable source (not shown) strikes the window surface substantially at a point or as a small spot and is scattered by a diffuser 10 in the window and immediately behind or combined with the target 9 which is transparent to the laser radiation. The camera 4 photographs the spot from the rear at the instant of impact by means of the electronic shutter 6 which is activated, in a manner knwon per se, by a signal from the weapon simulator to which it is coupled in a conventional manner (not shown).

As more clearly illustrated in FIG. 2, the window 2 comprises a glass cover 8 which is preferably of non-reflecting glass to prevent glare and which protects the target pattern 9 immediately behind it from dirt and abrasion. The target pattern 9, which may take and desired form, from line drawings such as that illustrated in FIG. 3, to photographs of objects, may be reproduced on either a film transparency or on a sheet of white paper or the like. If a transparent film is used, a diffuser 10, such as a sheet of white paper, an opal glass or translucent plastics material is desirable immediately behind the target 9. Of course if the film pattern is printed on a sheet of white paper or translucent plastic no additional diffuser is required.

In order to reduce the effect of varying ambient lighting as much as possible, a colour filter 11 is located immediately behind the diffuser 10. This filter is designed to block the ambient light but pass the light from the laser beam weapon simulator. The transmission characteristics of the filter must therefore be selected in relation to the colour of the light source selected. For example, if a He-Ne laser is used, red light having a wavelength of the order of 633 nm is produced and the filter should therefore be selected to block most of the visible light below about 600 nm in wavelength. A filter comprising several layers of Rubylith® (a trademark of Ulano Companies) has been found particulary suitable for this purpose. Other types of filters such as a laser line transmission filter could also be used but are generally not necessary or desirable by reason of their cost.

The filter is backed by a graticule 12 generally comprising a clear plastic sheet having a replica of the target engraved or otherwise reproduced on the filter side. The target replica is usually exactly aligned with the target 9 on the front of the screen. This is not, however, essential and it may be shifted with respect to the target to compensate for parallax effects caused by, for example, not mounting the weapon simulator on the axis of the sights. A grid pattern, such as that indicated at 14 in FIG. 4, may also be engraved or otherwise reproduced on the surface of the graticule, in addition to the replica of the target, to facilitate quantitative measurements of hit positions. A series of small lamps 13 or the like are provided around the periphery of the graticule to illuminate the engraved grid pattern in a manner similar to that found in such equipment as ocsilloscope screens. The camera is thus able to photograph the illuminated grid pattern and the weapon-simulator spot simultaneously from the rear and thus produce a permanent film record, a typical example of which is illustrated in FIG. 4. As will be observed, FIG. 4 represents the results of firing 3 shots, indicated by spots 15, at each of the six targets shown in FIG. 3. The grid lines 14 are conveniently about 5 mm apart and are recorded on the film even though they do not appear on the target visible to the marksman.

It will be appreciated that the front surface mirror 3 reverses the image to restore its orientation on the final film record. A simple rheostat (not shown) may be provided to control the intensity of lamps 13 to thereby permit relative adjustment of the graticule illumination and the light spot for proper exposure. The overall exposure is, of course, controlled in conventional manner by means of the shutter speed and/or the aperture diaphragm in the lens assembly. It will be appreciated that the film exposure is largely independent of the ambient lighting conditions and therefore the equipment can be used under a wide range of a lighting conditions without the need for adjustment and with very little set up time. The equipment is prefocused and such exposure adjustments as are necessary can readily be determined and calibrated by known means.

It will also be appreciated that the target presented to the marksman may be quite different to that photographed for the permanent record, i.e. the record image may be covered with a detailed grid or the like to aid in scoring the target hits while the target itself remains free of unnecessary and confusing lines.

What is claimed is:

1. In combination, a laser beam weapon simulator, a housing, film means in said housing, window means in said housing which is transparent to the laser beam from said weapon simulator, the laser beam emanating from said weapon simulator striking the surface of said window means as a small spot, said window means being receptive of a target having a desired target pattern, said window means further including graticule means provided with a grid pattern, camera optical means in said housing for producing on said film means an image of said target pattern and of said spot, illuminating means along the periphery of said graticule means for illuminating the grid pattern whereby the illuminated grid pattern may be photographed by said camera means, and filter means between said target and said camera optical means for blocking substantially ambient light from said film means and transmitting laser beam radiation.

2. The combination as recited in claim 1 wherein said window means comprises said target, said filter means and said graticule means in the order named.

3. The combination as recited in claim 2 wherein said window means further comprises a transparent protective cover.

4. The combination as recited in claim 1 wherein said target comprises a film transparency upon which said target pattern is reproduced and further comprising light diffusing means positioned behind said target.

5. The combination as recited in claim 1 wherein the pattern of said target is printed on a diffusion sheet which is translucent to laser radiation.

* * * * *

UNITED STATES PATENT AND TRADEMARK OFFICE

CERTIFICATE OF CORRECTION

PATENT NO. : 4,198,767

DATED : April 22, 1980

INVENTOR(S) : Robert W. Mac Pherson et al

It is certified that error appears in the above-identified patent and that said Letters Patent are hereby corrected as shown below:

On the title page:

Item [73] should read as follows:

Assignee: Her Majesty the Queen in Right of Canada, as Represented by the Minister of National Defence, Ottawa, Ontario.

Signed and Sealed this

*Ninth* Day of *December 1980*

[SEAL]

*Attest:*

SIDNEY A. DIAMOND

*Attesting Officer*

*Commissioner of Patents and Trademarks*